US005229982A

United States Patent [19]

Kuo

[11] Patent Number: 5,229,982

[45] Date of Patent: Jul. 20, 1993

[54] SWITCH ASSEMBLY OF AN ALARM CLOCK WITH A SNOOZE FEATURE MOUNTED THERETO

[76] Inventor: Davis Kuo, No. 4, Shin-Ho Rd., Tainan City, Taiwan

[21] Appl. No.: 713,269

[22] Filed: Jun. 11, 1991

[51] Int. Cl.[5] ..... G04B 23/00

[52] U.S. Cl. ..... 368/262; 368/250; 368/72

[58] Field of Search ..... 368/72, 250–271

[56] References Cited

U.S. PATENT DOCUMENTS 3,192,699 7/1965 Stout ..... 368/262
4,423,966 1/1984 Ogihara et al. ..... 368/262
4,435,796 3/1984 Saito et al. ..... 368/262
4,747,087 5/1988 Sakuma ..... 368/262

*Primary Examiner*—Bernard Roskoski
*Attorney, Agent, or Firm*—Cushman, Darby & Cushman

[57] ABSTRACT

A switch includes a first plate with an upper edge and a lower edge. A sectoral recess is formed in the first plate extending from the upper edge. A curved groove is formed through the sectoral recess. A second plate has a latch and a projection extending from the second plate in a direction opposite the other. The second plate is provided in the sectoral recess with the latch slidably engaging in the curved groove of sectoral the recess. The second plate can move sideways in the sectoral recess.

3 Claims, 6 Drawing Sheets

SWITCH ASSEMBLY OF AN ALARM CLOCK WITH A SNOOZE FEATURE MOUNTED THERETO

BACKGROUND OF THE INVENTION

1. Field of Invention

The invention relates to an alarm clock, more particularly to the construction of a switch assembly of an alarm clock having a snooze feature mounted thereto.

2. Description of the Related Art

It is common knowledge that we use an alarm clock to set a predetermined time when we wish to awake at that particular hour. We are also in the habit of stopping the alarm button once awakened from sound sleep and then falling back to sleep again. Many times when we awake again, we have over slept which in turn causes tardiness with the appointed hour.

With the advance of modern technology, much improvement has been made to the already existing alarm clock so as to facilitate our daily necessities. A snooze feature has been installed in the existing alarm clocks in order to eliminate the above-mentioned drawback. The snooze feature was provided in the alarm clock and made by a known related art to send out a second alarm at a set time shortly after the first alarm has stopped.

FIG. 1 shows an exploded view of a switch assembly of an alarm clock which has a snooze feature provided therein and includes a first plate B having an elongated groove B1 at top portion thereof, two vertical slots (B2,B5) and a projection B3, a second plate C slightly bigger than the first plate B having two projections adapted to pass through the elongated groove Bl being attached alongside to said first plate B by means of rivets C3. A casing A has a hook A5 and two projections A1 and A5, respectively aligned with said vertical slots B2 and B5 of said first plate B and a leaf spring A4. The first plate B is provided in the casing A and connected thereto by rivet means while one end of the leaf spring A4 abuts the projection B3 of said first plate in an upward position, as shown in FIG. 2, so that the first plate B will rise again if imparted pressure is released therefrom. In order not to let the first plate B rise again, the first plate B is slid sideways after being pressed, wherein the hook A5 of the casing will lock the first plate B, as shown in FIG. 3. Thus arranged, the alarm will not ring again at another set time.

The connection of the first and second plates, and fixing of the leaf spring on the casing are done wholly by a rivet soldering method. In case a part of above assembly is need to be replaced due to some reason, the whole assembly must be disassembled, rendering it useless, since soldered rivets can not be easily disassembled.

Apart from that, the alarm clock of above-mentioned type looks unattractive since it has two clearances N1 and N2 at its front portion, as shown in FIG. 4.

SUMMARY OF THE INVENTION

Therefore, the main object of the present invention is to provide a switch assembly having components which can be easily assembled and disassembled while at the same time avoiding damage to the equipment.

Another object of the present invention is to provide a switch assembly which will look more attractive in comparison to prior art models.

Accordingly, the switch assembly of an alarm clock is provided. The alarm clock includes a casing having a rear wall, a front wall and a side wall interconnecting said rear and front wall and a slot therethrough. A protrusion extends inwardly from the rear wall adjacent to the slot. The switch assembly includes a first plate having a curved upper edge and a horizontal bottom edge with a recess extending from the curved upper edge. A curved groove is formed in said recess. An arched recess extends between the free ends of the horizontal edge which arched recess coincides with said recess. The switch assembly also includes a second plate that has a latch and two arms extending laterally is provided in said recess with said latch slidably engaged in the curved groove of the first plate. An arm of the second plate has a projection extending to a direction opposite of the latch. The first plate is provided in the slot of the side wall. The bottom end of the first plate is connected to a frame slidably mounted on a moving mechanism fixed in the casing. A spring that has one end connected to the frame and another end connected to the moving mechanism piece in such a manner that the upper end of the first plate is pushed upward, protruding outward of said casing through said slot. The first plate is compressible when said latch is moved in the curved groove of the recess to a position away from the protrusion of the rear wall. The first plate is incompressible when the latch is moved in the curved groove to another position where the protrusion of the rear wall is stopped by the projection of the arm of the second plate from being pushed upward by the spring.

BRIEF DESCRIPTION OF THE DRAWINGS

Other features and advantages of the present invention will become more apparent in the following detailed description, including the drawings, all of which show a non-limited form of the invention, and of which.

DETAILED DESCRIPTION OF THE PREFERRED EMBODIMENT

Figure 5:
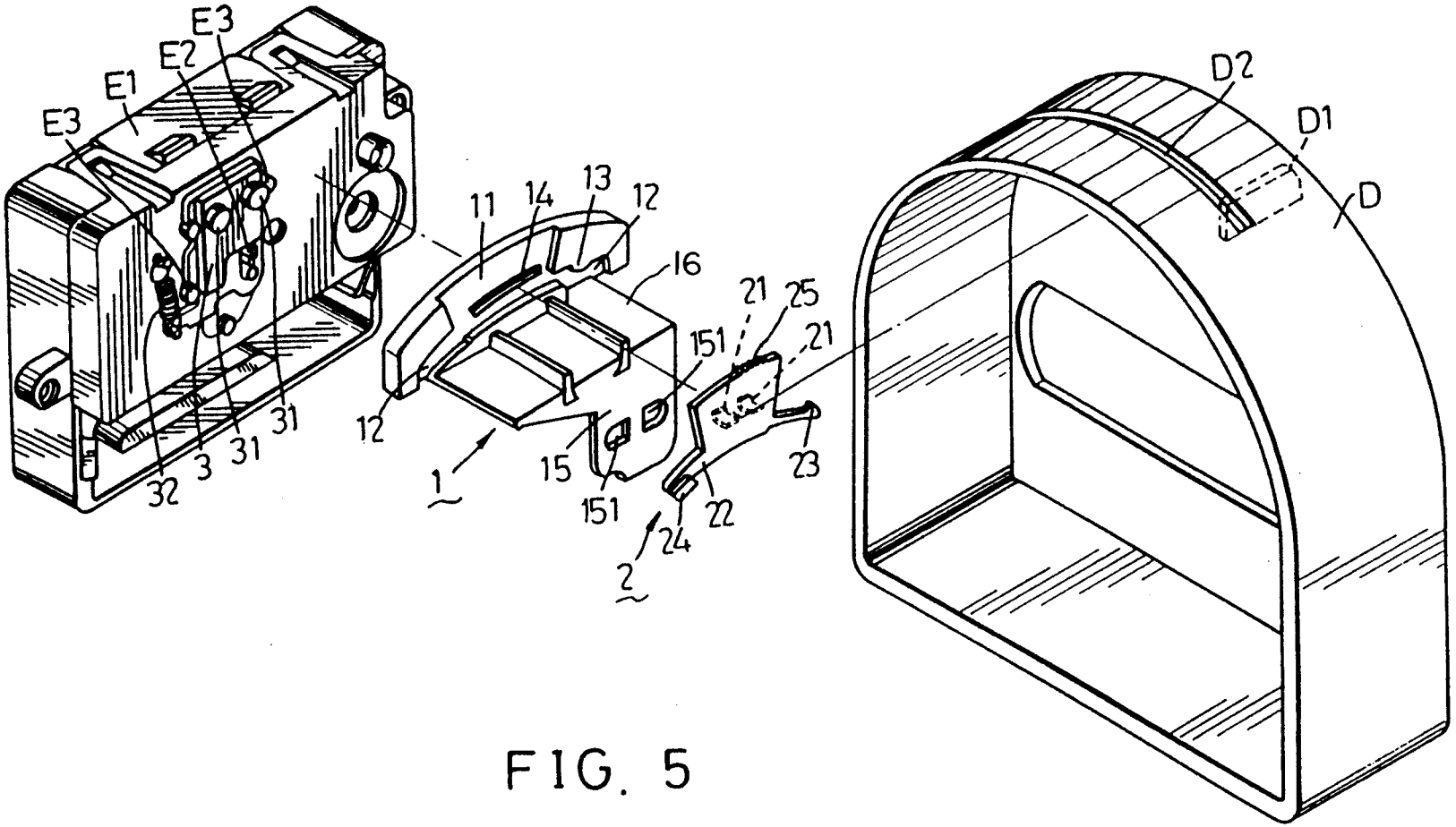
FIG. 5 shows an exploded view of a switch assembly of the present invention for an alarm clock.

Referring to FIG. 5, a switch assembly of an alarm clock of the present invention is shown. The alarm clock includes to comprise a casing including a rear wall, a front wall (not shown) and a side wall (D) interconnecting said front and side wall and having a slot (D2) therethrough. The rear wall has a projection (D1) extending into the casing (D) adjacent to said slot (D2) of the side wall.

The suited assembly includes a first plate (1) with substantial thickness having a curved upper edge, a horizontal edge and a sectoral recess (11) extending from the curved upper edge. A curved groove (14) is formed through said sectoral recess. An arched recess

Figure 1:
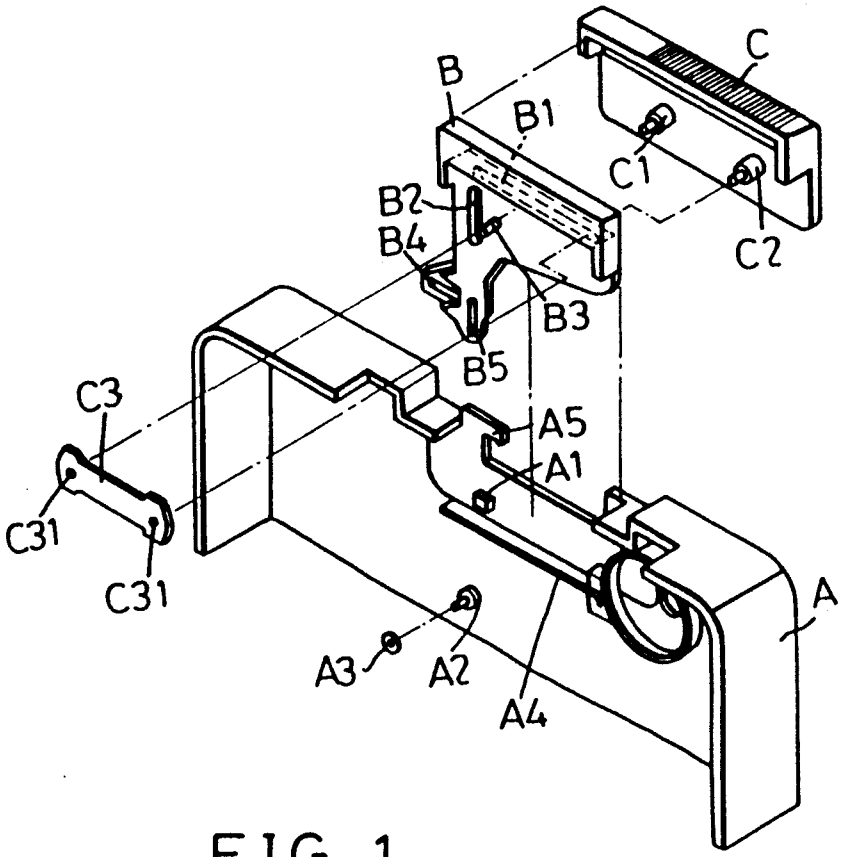
FIG. 1 (PRIOR ART)
FIG. 1 shows an exploded view of a switch assembly of an alarm clock of prior art.
Figure 2:
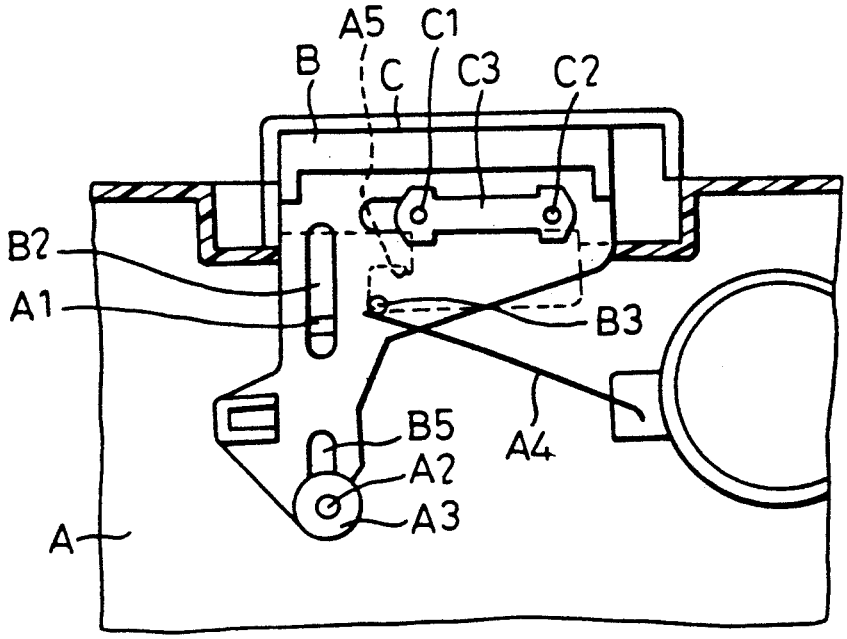
FIG. 2 (PRIOR ART)
FIG. 2 shows the switch assembly of FIG. 1 in a raised position.
Figure 3:
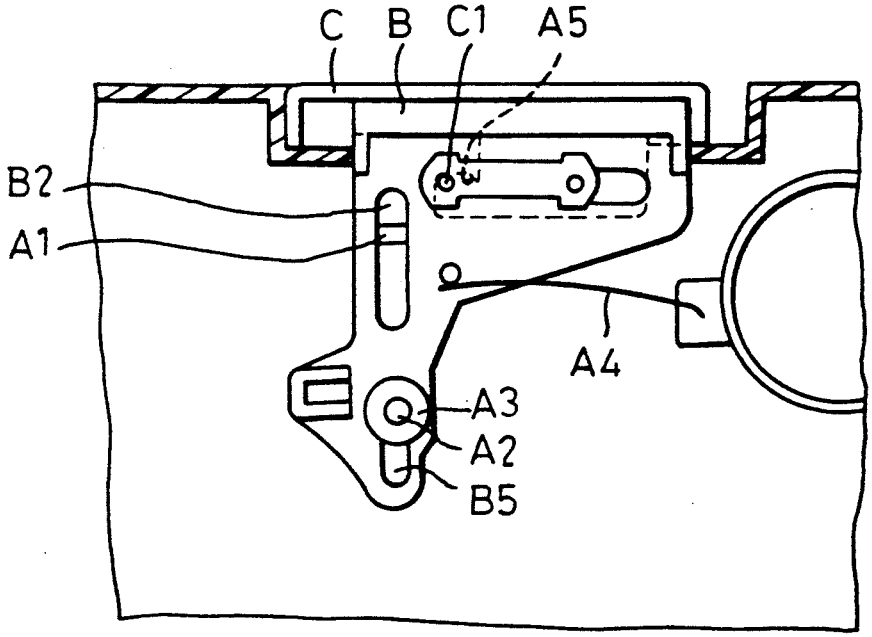
FIG. 3 (PRIOR ART)
FIG. 3 shows the switch assembly of FIG. 1 in a compressed position.
Figure 4:
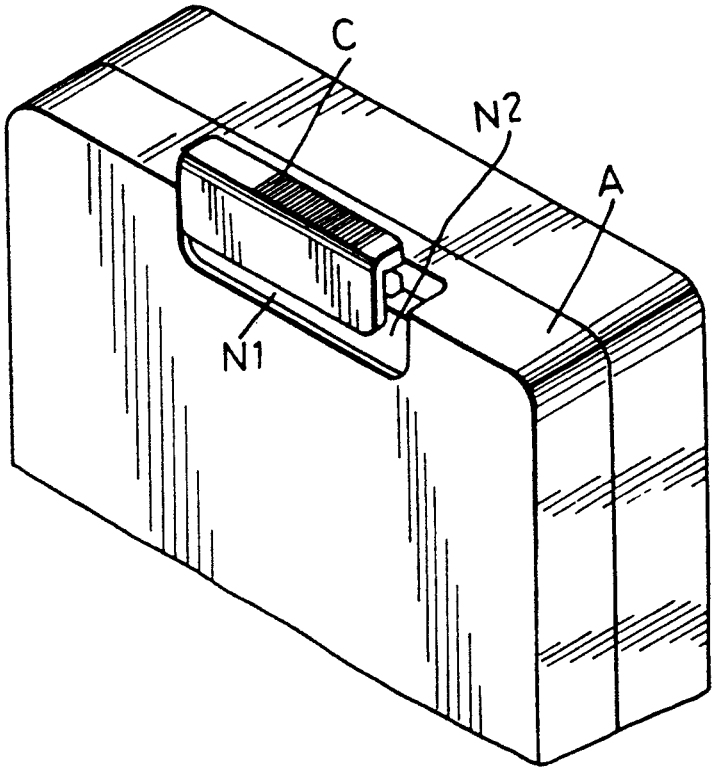
FIG. 4 (PRIOR ART)
FIG. 4 is a front view of the alarm clock of FIG. 1.

(12) extends from the free ends of the horizontal edge, coinciding with said sectoral recess (11). The arched recess (12) has a stop member (13) therein. The first plate (1) is disposed in the slot (D1) of the side wall (D) as shown in FIG. 1. The first plate (1) further includes a second portion (16) extending rearwardly and having a length equal to the thickness of a clock moving mechanism (El) of the alarm clock and a third portion (15) extending substantially and perpendicularly therefrom with a pair of mounting holes (151).

The suited assembly includes a second plate (2) having a thickness equal to the depth of the sectoral recess (11), a curved upper edge with a serration (25), a pair latch (21), and two arms (22) laterally extending from the bottom end of the second plate. Each arm (22) has a protrusion (23,24) each with a different orientation. The second plate (2) is provided in said sectoral recess (11) where the latches (25) slidably engage in the curved groove with said arms being disposed in the arched recess (12) and the upper curved edge of the second plate (2) slightly protruding from the sectoral recess (11). The latch (21) moves in the curved groove (14) when the second plate (2) is pushed sideways where the protrusion (23) of the arm (22) moves on either side of the stop member (13). By provision of the serration portion (25) at the upper edge, one's finger will not slip when pushing the second plate (2).

A frame (3) has a pair of protrusions (31) and is slidably mounted on the clock moving mechanism piece (El) which is fixed in the casing between the front and rear wall. The moving mechanism piece (El) has a plurality of studs (E3) which help to guide the frame (3) therebetween.

Figure 6:
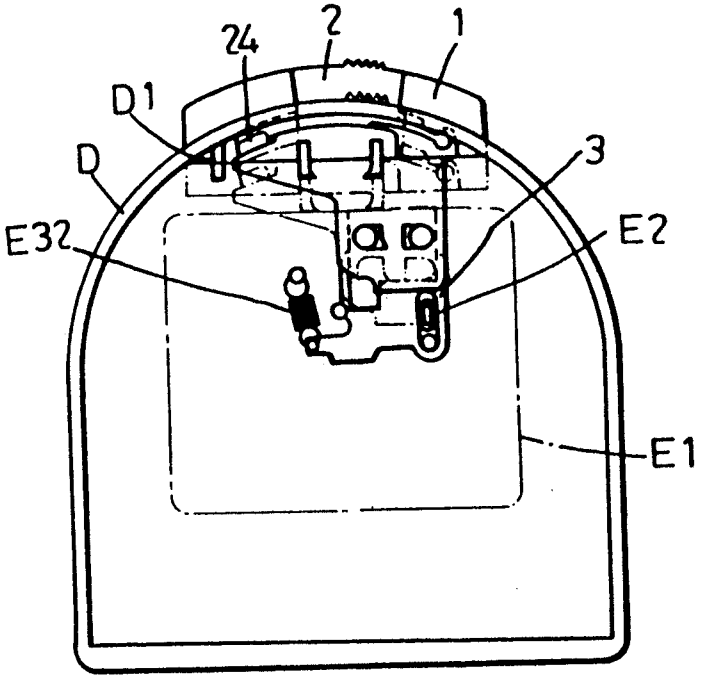
FIG. 6 shows the switch assembly of the present invention installed in an alarm clock, illustrating the switch assembly being in a compressible position.

A spring (32) has one end connected to the moving mechanism piece and the other end connected to the frame (3), urging the frame in an upward position. During assembly, the protrusion (31) is inserted into the mounting holes (151) of the first plate (1) so the curved upper edge of the same will protrude from the casing through the slot (D2) of the side wall (D), as shown in FIG. 6. The moving mechanism piece (E1) further has a push button (E2) extending out of the piece (E1), which is associated with an alarm circuit arranged in a known related art to send out an alarm at a pre-set time. The connection relationship of alarm circuit has nothing to do with the present invention, therefore, discussion of such will be omitted. It is seen from the illustration that the projection (24) of the arm of the second plate (2) is disposed above the protrusion (D1) of the real wall. Under this condition, the switch assembly can move up and down so that it can be pressed downward, simultaneously moving the frame (3) downward thereby pushing the button (E2) to disconnect an alarm signal when the alarm is set for the pre-set time. The perforated lines depict the position of the switch assembly in a pressed condition. Once the imparted pressure is released, the switch assembly will be pushed upward again by the spring (32). Sending out another alarm at a short time interval is also known in the art and therefore does not require further explanation.

Figure 7:
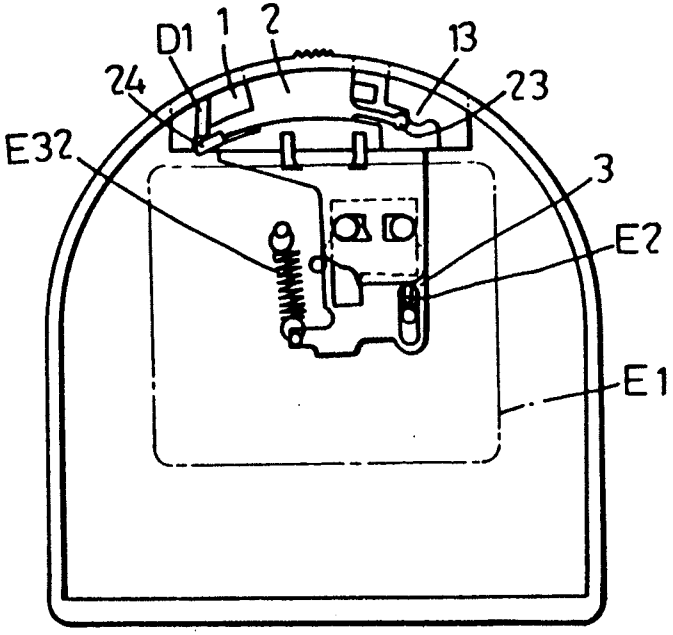
FIG. 7 is the switch assembly of FIG. 6 illustrating in a incompressible position.

Alternatively, if the sleeper is fully awake and a second alarm is not necessary, then he can move the second plate (2) sideways while pressing the switch assembly downward, wherein the latch (21) will move in the curved groove (14) to a position where the projection (24) of the arm (22) will be underneath of the protrusion (D1) of the rear wall. Under this condition, the frame (3) is constantly pushing the button (E2) thereby disconnecting the alarm circuit. In another words, the switch assembly can not be pressed downward in this condition, as shown in FIG. 7.

Figure 8:
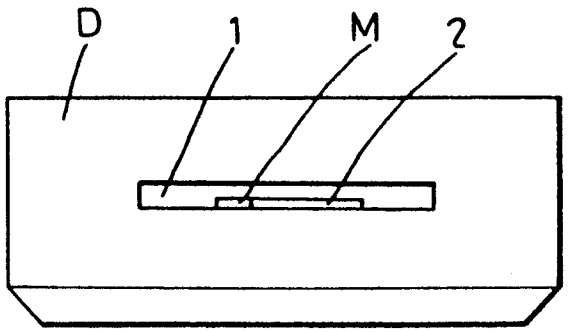
FIG. 8 is a top view of the switch assembly of the present invention.

FIG. 8 shows a top view of the switch assembly of present invention incorporated into an alarm clock. It is seen from the illustration that only a small clearance M remains between the first and second plates which is not visible from the front and side views.

From the above explanation, the switch assembly of the present invention does not use rivets or other soldering methods, but only simple insertion of pieces. This is the most distinct feature of the present invention. In addition, the switch assembly of the present invention looks more attractive in comparison to prior art models.

With the invention thus explained, it is obvious to those skilled in the art that various modifications and variations can be made without departing from the scope and spirit of the present invention. It is therefore intended that this invention be limited only as in the appended claims.

I claim:

1. An alarm clock having a casing, the casing including a front wall, a rear wall and a side wall connected between the front and rear walls, the side wall having a slot defined in a surface thereof, the rear wall having a protrusion extending into the casing adjacent the slot of the side wall, the alarm clock further including a clock movement mechanism disposed within the casing, the movement mechanism including a button associated with an alarm circuit, the button being electrically disconnected from the alarm circuit when actuated, and a switch assembly comprising:

a first plate having upper and lower edges, a sectoral recess being formed on a surface of said first plate extending upward from said upper edge, said surface including a groove defined therethrough, said first plate including an engaging member extending downward from said lower edge thereof;

a second plate including an upper end, said second plate including a latch element and a projecting element extending from a bottom thereof, said latch element being slidably disposed within said groove, said second plate being disposed within said sectoral recess, said upper edge of said second plate protruding outward from said sectoral recess, a frame movably mounted on the moving mechanism of the alarm clock, said engaging member of said first plate being engaged with said frame; and a spring member having one end thereof affixed to said frame, a second end of said spring member being affixed to said frame so as to bias frame in one direction, said spring member urging said frame to push said upper edge of said first plate through the slot in the side wall of the alarm clock so as to protrude out of the casing, said first plate being vertically moveable in the slot when said latch element is moved in said groove to a position where said projection of said second plate is disposed away from the protrusion of the rear wall permitting said frame to engage the button, said first plate being vertically stationary when said latch is moved to a second position where said projection of said second plate is stopped by the protrusion of the rear wall, preventing said upper edge of the first plate from protruding out of the casing while permitting said frame to continuously press the button.

2. A switch assembly as claimed in claim 1, wherein said first plate includes an arched recess extending from free ends of said lower edge and coinciding with said sectoral, recess, a stop member being formed in said arched groove, said second plate including two arms laterally extending therefrom being disposed in said arched recess, said projection of said second plate extending from one of said arms, and the other said arm of said pair of arms having a protrusion which can move on two sides of said stop member when said latch is moved in said groove.

3. A switch assembly as claimed in claim 1 wherein said upper end of said second plate is serrated.

* * * * *